US009153409B2

(12) United States Patent
Wiedmann et al.

(10) Patent No.: US 9,153,409 B2
(45) Date of Patent: Oct. 6, 2015

(54) COUPLED MAGNET CURRENTS FOR MAGNETIC FOCUSING

(71) Applicant: General Electric Company, Schenectady, NY (US)

(72) Inventors: Uwe Wiedmann, Clifton Park, NY (US); Antonio Caiafa, Albany, NY (US); Dominique Poincloux, Paris (FR)

(73) Assignee: General Electric Company, Niskayuna, NY (US)

( * ) Notice: Subject to any disclaimer, the term of this patent is extended or adjusted under 35 U.S.C. 154(b) by 161 days.

(21) Appl. No.: 14/061,509

(22) Filed: Oct. 23, 2013

(65) Prior Publication Data

US 2015/0110251 A1 Apr. 23, 2015

(51) Int. Cl.
*H01J 35/14* (2006.01)

(52) U.S. Cl.
CPC ..... *H01J 35/14* (2013.01)

(58) Field of Classification Search
CPC ..... H01J 35/14; H01J 35/30; H01J 35/16; H01J 2235/086; H01J 35/06; H01J 2235/068; H01J 2235/1216; H01J 35/08; H01J 35/10; H01J 35/305; H01J 2235/062; H01J 2235/16; H01J 35/045; H01J 35/065; H01J 2235/081; H01J 2235/162
USPC ..... 378/121, 137, 138
See application file for complete search history.

(56) References Cited

U.S. PATENT DOCUMENTS

| | | | | |
|---|---|---|---|---|
| 6,339,635 | B1 | 1/2002 | Schardt et al. | |
| 7,409,043 | B2 | 8/2008 | Dunham et al. | |
| 7,839,979 | B2 | 11/2010 | Hauttmann et al. | |
| 8,265,227 | B2 | 9/2012 | Boudry et al. | |
| 8,320,521 | B2 | 11/2012 | Zou et al. | |
| 2010/0020938 | A1 | 1/2010 | Koch et al. | |
| 2012/0177185 | A1 | 7/2012 | Koppisetty et al. | |
| 2012/0281815 | A1* | 11/2012 | Ferger et al. | 378/138 |
| 2013/0051532 | A1* | 2/2013 | Caiafa | 378/110 |
| 2014/0169530 | A1* | 6/2014 | Frontera et al. | 378/137 |

FOREIGN PATENT DOCUMENTS

WO 2008155695 A1 12/2008

OTHER PUBLICATIONS

Wen et al., "X-Ray Tube in Parallel Magnetic Fields", Proc. SPIE 5030, Medical Imaging 2003: Physics of Medical Imaging, Jun. 9, 2003.

Behling, R., et al.; "P4-15: High current x-ray source technology for medical imaging," Vacuum Electronis Conference (IVEC), 2010 IEEE International, May 18-20, 2010; pp. 475-476.

* cited by examiner

*Primary Examiner* — Irakli Kiknadze
(74) *Attorney, Agent, or Firm* — Robert M. McCarthy

(57) ABSTRACT

Issues related to maintaining the size of a focal spot on the target material of an X-ray source are addressed by linking the currents used in a magnetic focusing system employed in the X-ray source. The size of the focal spot on the target is less sensitive to current changes applied to the magnetic focusing system due to this linkage.

22 Claims, 6 Drawing Sheets

COUPLED MAGNET CURRENTS FOR MAGNETIC FOCUSING

BACKGROUND

In various types of non-invasive imaging systems, radiation may be generated and transmitted through a volume of interest, in which may be placed a patient under examination, a piece of baggage or a parcel undergoing security screening, or an article of manufacture undergoing quality review. A portion of the radiation that passes through the volume impacts a digital detector or a photographic plate where the X-ray transmission data is collected. In digital X-ray systems a photodetector produces signals representative of the amount or intensity of radiation impacting discrete elements of a detector surface. The signals may then be processed to generate a two-dimensional or three-dimensional image that may be displayed for review.

In certain such non-invasive imaging systems, X-ray tubes or other X-ray generation technologies are used as the source of the radiation that is transmitted through the imaged volume. The X-rays are generally emitted in response to control signals that may be specified by a suitable examination protocol. Typically, the X-ray tube includes a cathode and an anode. An emitter within the cathode may emit a stream of electrons directed toward the anode. The anode may include a target that is impacted by the stream of electrons. The target may, as a result of impact by the electron beam, produce X-ray radiation that may be directed through an imaged volume of an imaging system.

In X-ray tubes, magnetic focusing may be used to focus the electron beam onto the target. However, it may be difficult to maintain the desired focal spot size for a respective imaging application on the target due to current changes that may occur with respect to the elements used to generate the magnetic fields used to focus the electron beam. That is, changes in the current passing through these magnetic field generating elements may result in undesired variance in the size of the focal spot where the electrons impact the target for a particular imaging application. Such variance in the size of the focal spot may lead to undesired image artifacts or reduced image quality.

BRIEF DESCRIPTION

In one embodiment, an X-ray tube is provided. The X-ray tube comprises a target and a cathode assembly comprising a cathode configured to emit a stream of electrons toward the target during operation. The X-ray tube further comprises a magnetic focusing assembly configured to focus the stream of electrons onto a focal spot on the target during operation. The magnetic focusing assembly comprises a first quadrupole magnet assembly configured to generate a first magnetic field when a current is applied and a second quadrupole magnet assembly configured to generate a second magnetic field when a current is applied. The first magnetic field and the second magnetic field in combination focus the electron beam on the focal spot. The first magnetic field and the second magnetic field are held in a substantially fixed ratio to one another during operation such that the size of the focal spot on the target remains substantially constant when the current through the quadrupole magnet assemblies is changed.

In a further embodiment, a system employing generated X-rays is provided. The system comprises an X-ray controller configured to generate control signals and an X-ray source configured to generate X-rays in response to the control signals. The X-ray source comprises an electron emitter configured to emit a stream of electrons, a target configured to emit X-rays when impacted by the stream of electrons, a first quadrupole configured to generate a first magnetic field, and a second quadrupole configured to generate a second magnetic field. The first magnetic field and the second magnetic field in combination focus the stream of electrons on the target. The first magnetic field and the second magnetic field are maintained in a substantially fixed relationship to one another such that the size of the focal spot where the stream of electrons is incident on the target remains substantially constant when the current through the quadrupole magnet assemblies is changed.

In an additional embodiment, a method is provided for focusing an electron beam within an X-ray source. The method comprises the act of emitting a stream of electrons toward a target material. The stream of electrons is incident on the target material within a focal spot. The stream of electrons is magnetically focused on the target material by passing the stream of electrons through a first magnetic field and a second magnetic field. The first magnetic field and the second magnetic field are maintained in a substantially fixed ratio to one another even when a current used to generate at least one of the magnetic fields is changed. X-rays are emitted from the focal spot on the target material.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
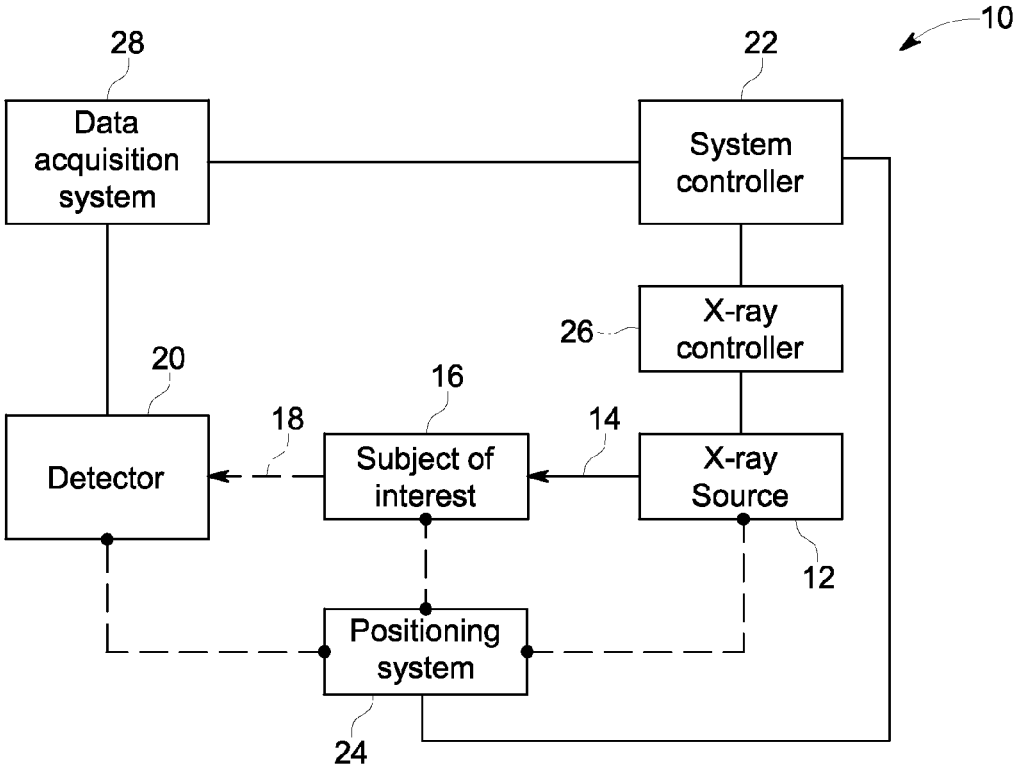
FIG. 1 is a block diagram illustrating an embodiment of a system that uses an X-ray source configured to generate X-ray in accordance with aspects of the present disclosure.

In X-ray based imaging modalities (such as computed tomography (CT), X-ray fluoroscopy, mammography, C-arm angiography, tomosynthesis, and so forth), as well as in certain treatment systems (such as X-ray based radiation therapy), the quality of the procedures performed may depend at least in part on the ability of the X-ray source to produce X-rays within specified constraints. As part of the X-ray generation, an electron beam is typically directed toward a target anode to produce X-rays. The electron beam may be focused using a quadrupole magnetic field applied between the electron emitter and the target. By way of example, this can be done using two independent magnetic quadrupoles, e.g., a cathode-side or cathode-facing quadrupole and a target-side or target-facing quadrupole.

To produce and change the magnetic fields used to focus the electron beam, a current may be passed through coils of the quadrupole via a control circuit. The control circuit may vary the current that flows through the coils as part of the magnetic focusing operation, which in turn affects the magnetic field produced by each coil. However, as the current passing through each of the quadrupole windings is changed, the generated magnetic quadrupole field changes in response. As a consequence, the size of the focal spot on the target also changes.

In some instances, the size of the focal spot (which may be characterized by one or both of the length or width of the area of incidence, or by any other parameter characterizing focal spot distribution, such as a modulation transfer function (MTF) in width and/or length direction) is very sensitive to quadrupole current changes. In an extreme case, this sensitivity of the size of the focal spot to these current changes is so high that the necessary current accuracies are technically difficult or costly to achieve. In particular, operational parameters having low tube voltage and high tube current are particularly susceptible to focal spot size sensitivity in response to change in the quadrupole current. For example, it may be desirable to limit fluctuations in focal spot size to ±1%, which may require quadrupole current accuracy better than 0.1% of full scale and in certain configurations, may actually require quadrupole current accuracy up to 0.01% of full scale.

As discussed herein, the present approach addresses these issues by linking the quadrupole currents in both quadrupoles in such a way that the size of the focal spot on the target is less sensitive to current changes through the quadrupoles. In certain embodiments, the ratio of the quadrupole currents is substantially fixed, which reduces the sensitivity of the size of the focal spot to current changes. In particular, it has been found that an essentially constant quadrupole current ratio is adequate for focusing an electron beam for X-ray applications within a wide range of both X-ray tube voltage and X-ray tube current operating points. That is, different types of X-ray imaging examinations have different X-ray tube voltage and current operating points for which focal spot size need to be maintained, and quadrupole currents need to be adjusted to accommodate these voltage and current operating points. At all these different operating points, the electron beam can be focused with an essentially constant quadrupole current ratio. The present approach of employing an essentially constant quadrupole current ratio allows focal spot size to be maintained at the different tube operating points, while minimizing sensitivity to quadrupole current levels.

With the foregoing in mind, a general discussion of X-ray generation components and systems employing such components is initially provided to give context for the present X-ray generation concepts and to simplify explanation of such concepts. Accordingly, FIG. 1 provides a non-limiting example of a system 10 that may include control circuitry and control logic in accordance with the present approaches. Specifically, FIG. 1 is a block diagram illustrating a general system 10 that uses an X-ray radiation source 12 for performing a quality control, a security screening, a medical imaging (e.g., a CT imaging system or other X-ray based imaging system), and/or a treatment procedure. The X-ray radiation source 12 may include one or more X-ray tubes having magnetic focusing features as discussed herein. The X-ray source 12 produces one or more streams of X-ray radiation 14 that are directed towards a volume or region of interest 16, such as a patient in a medical context. In certain implementations, the X-ray radiation is attenuated when passing through the volume of interest (such as due to passage through the tissues of a patient), resulting in a beam of attenuated X-rays 18. In the depicted example, the beam of attenuated X-rays 18 impacts a detector 20 in communication with a data acquisition system 28, which in combination provide signals representative of the X-ray transmission through the subject of interest. The data acquisition system 28 may include signal converters (e.g., A/D converters), device drivers, processing chips, memory, and so on. In some embodiments, the data acquisition system 28 converts analog signals received from the detector 20 into digital signals that can be further processed by one or more processing circuits (e.g., a computer-based processor) of the system controller 22. In other examples, such as where the X-rays are administered to the subject of interest 16 as part of a radiation therapy regime, the detector 20 and data acquisition system 28 may be absent or modified to support the therapy functionality.

In the depicted example, a system controller 22 commands operation of the system 10 to execute examination, treatment and/or calibration protocols and to process the acquired signals. The system controller 22 may include signal processing circuitry and associated memory or storage circuitry. In such embodiments, the memory or storage circuitry may store programs, routines, and/or encoded algorithms executed by the system controller 22 to operate the system 10, in accordance with the approaches discussed herein. In one embodiment, the system controller 22 may be implemented as all or part of a processor-based system such as a general purpose or application-specific computer system. In some embodiments, the data acquisition system 28 is in communication with the system controller 22, which may command acquisition of the signals generated in response to the X-rays and which may, in turn, adjust operation of the X-ray source 12 based on the data generated by the data acquisition system 28.

The system controller 22 may also control operation of a positioning system 24 that is used to move components of the system 10 (e.g., a C-arm or gantry and/or an examination table). For example, the X-ray source 12 may be positioned about the subject of interest 16 by the positioning system 24 in contexts where the X-ray source 12 is moved relative to the subject 16. The positioning system 24, as illustrated, may also be connected to the detector 20. However, in other embodiments, the detector 20 may be stationary. The positioning system 24 may displace either or both of the X-ray source 12 and the detector 20 to allow the source 12 to image or treat the subject of interest 16 from a variety of positions. In addition, the positioning system 24 may coordinate movement of an examination table upon which the subject 16 is positioned.

As depicted, the source 12 may be controlled by an X-ray source controller 26 contained within or otherwise connected to the system controller 22. The X-ray source controller 26 is configured to provide power and timing signals to the source 12. For example, the system controller 22, via the X-ray controller 26 may furnish power, focal spot location, focal spot size, control signals and so forth, for the X-ray exposure sequences. In accordance with an aspect of the present disclosure, the system controller 22 and/or X-ray source controller 26 may include one or more control circuits configured to control operation of the quadrupole magnetic fields used to magnetically focus the electron beam onto the target within the X-ray source 12, as discussed herein.

Figure 2:
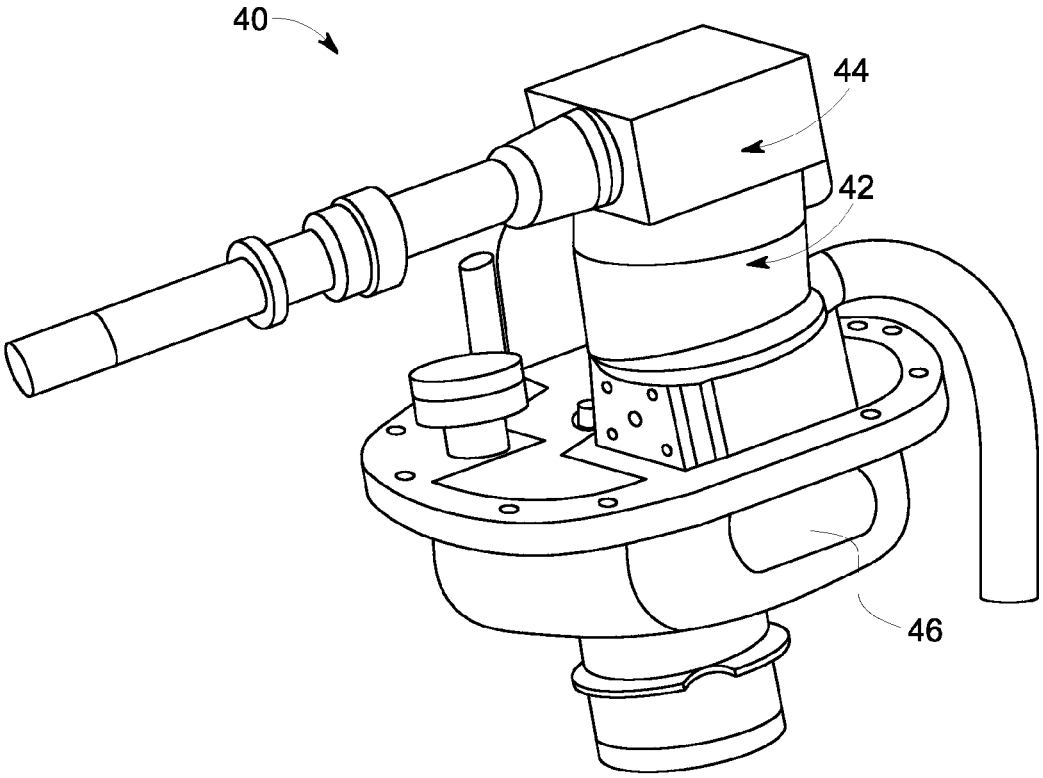
FIG. 2 is a schematic view of an embodiment of an X-ray tube configured to emit X-rays in accordance with aspects of the present disclosure.

With the foregoing discussion in mind, the magnetic focusing techniques described herein may be utilized in conjunction with an X-ray based system 10, as discussed above. By way of example, FIG. 2 illustrates an implementation of an X-ray tube 40 suitable for use as a component of the X-ray source 12 of system 10. In the embodiment illustrated in FIG. 2, the X-ray tube 40 includes a cathode assembly 44 that accelerates a stream of electrons through the X-ray tube 40, including through a magnet assembly 42 that contains focusing coils and may or may not contain steering coils. For example, the magnet assembly may include, in one implementation, two quadrupole magnet assemblies configured to magnetically focus the stream of electrons within the X-ray tube 40. As a result of the impact of the electrons with a target within the X-ray tube 40, X-rays are produced. Focal X-ray radiation is emitted through the window 46, where it may be useful in obtaining X-ray imaging data.

Figure 3:
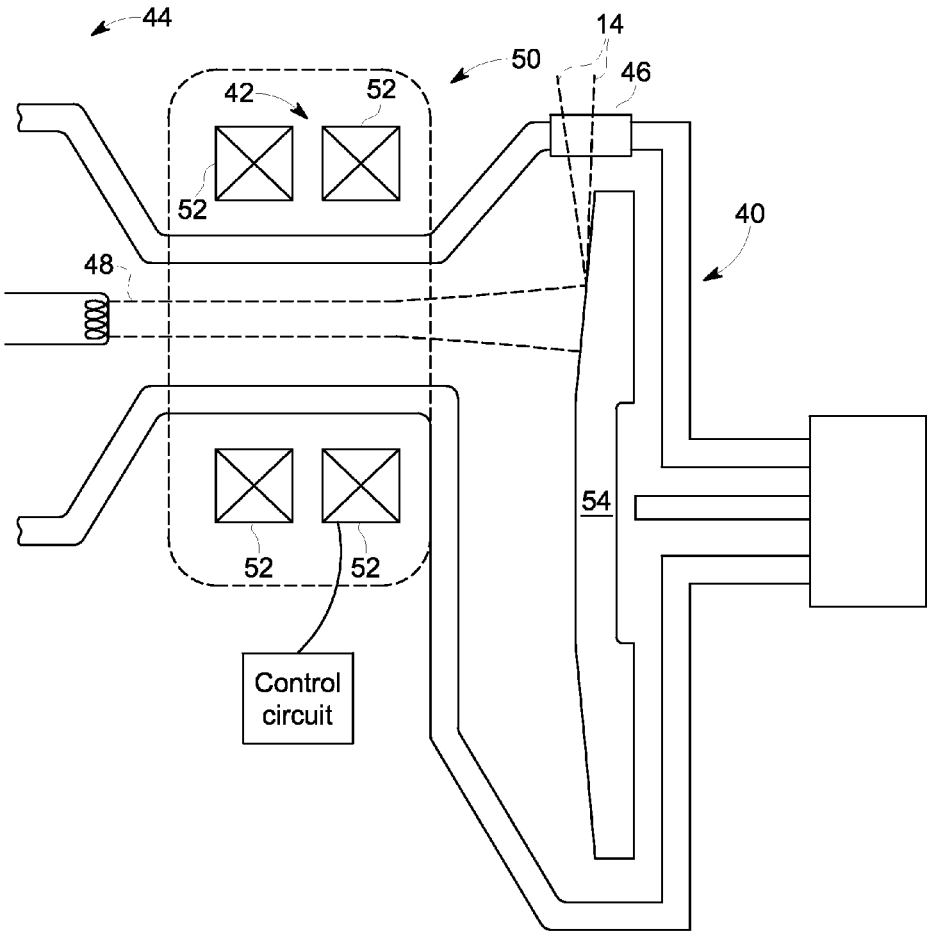
FIG. 3 is a schematic view of components of an X-ray tube, in accordance with aspects of the present disclosure.

FIG. 3 depicts a cross-sectional view of the X-ray tube embodiment of FIG. 2. As noted above, the cathode assembly 44 may accelerate an electron stream 48 through the X-ray tube 40. The electron stream 48 may pass through a throat, or electron beam pipe, 50 of the magnet assembly 42. As the electron stream 48 passes through the electron beam pipe 50, the magnet assembly 42 may generate electromagnetic fields using electromagnets 52, thereby controlling the size and position of electron stream 48. Thus, the magnet assembly 42 provides for focusing, and possibly steering, of the electron stream 48. In the depicted example, the electron stream 48 collides with a target 54. Focal X-ray radiation 14 is produced as electrons impact the target 54 and the radiation is emitted through the window 46. The magnet assembly 42 may obtain structural support by being in support base. The support base may be designed to receive and couple magnetic sub-assemblies 52 making up the magnet assembly 42.

Figure 4:
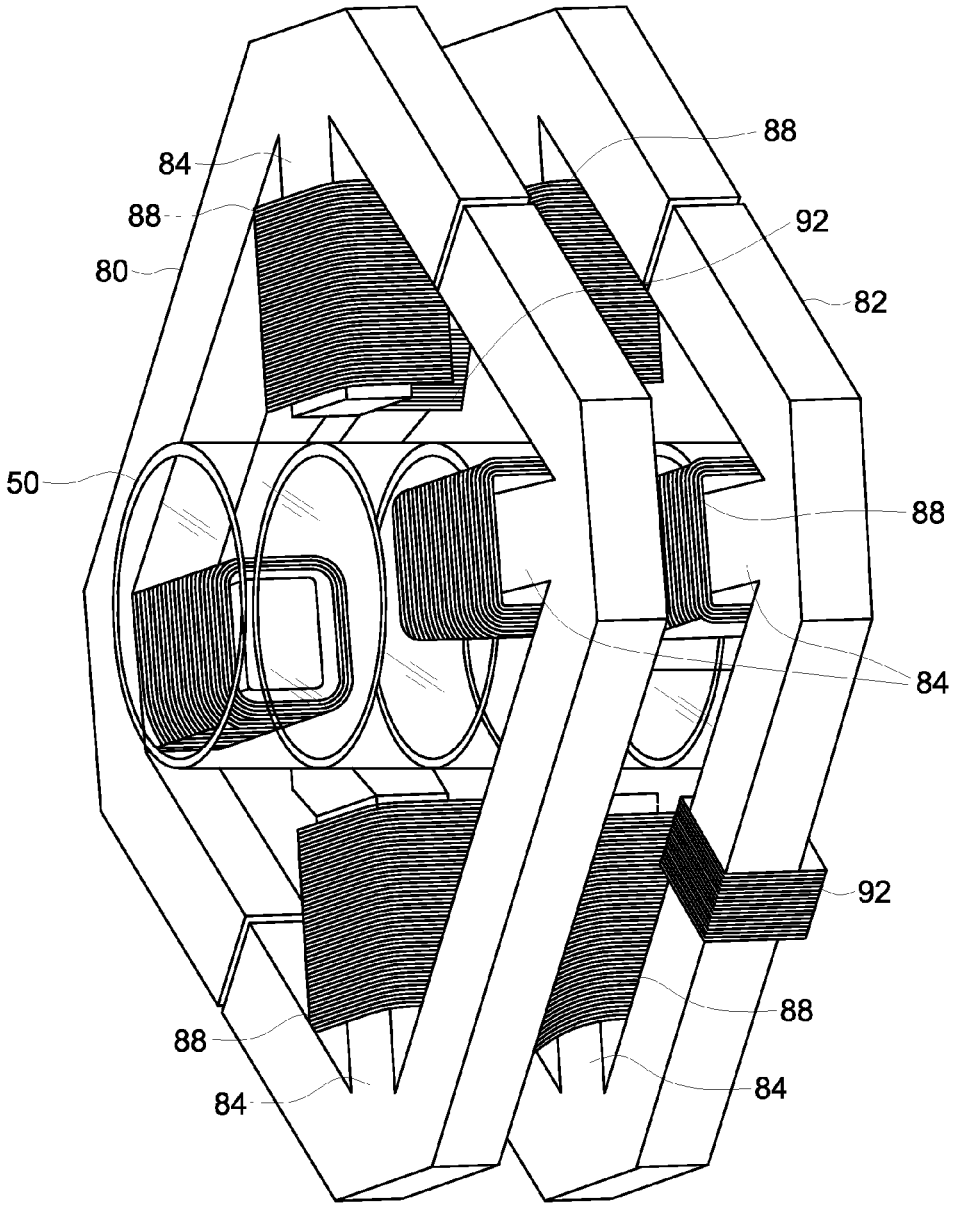
FIG. 4 depicts a magnet assembly for use in conjunction with an X-ray tube, in accordance with aspects of the present disclosure.

Turning to FIG. 4, an embodiment of a magnet assembly 42 that includes a pair of quadrupole magnet assemblies (i.e., cathode-side quadrupole 80 and target-side quadrupole 82) is depicted. In the depicted example the magnet assembly 42 may include a plurality of cores (i.e., cathode side cores and target side cores) forming the respective quadrupole assemblies. The cathode-side quadrupole 80 and target-side quadrupole 82 may include radial extensions 84, which may act as poles for the magnet subassembly 42.

The cathode-side quadrupole 80 and target-side quadrupole 82 may include coils 88 created by winding wire around portions of the cathode-side quadrupole 80 and target-side quadrupole 82. As illustrated, the cathode-side quadrupole 80 may include wire coils 88 formed along the radial extensions 84 of the cathode-side quadrupole 80. Similarly, the target-side quadrupole 82 may also include a plurality of coils 88 formed along the respective radial extensions 84. Additional target-side coils 92 may be formed on spans of the target-side quadrupole 82. Dipole and quadrupole windings may be formed on the same pole piece to make the assembly compact by utilizing the same poles for both focusing and deflection.

In the depicted example, the respective quadrupoles 80, 82 may be constructed in pieces or segments (e.g., halves in the depicted embodiment). The full magnet assembly of FIG. 4, therefore, may include two cathode-side quadrupole halves, two target-side quadrupole halves, eight radial extensions 84 (four on the cathode-side quadrupole 80 and four on the target-side quadrupole 82), four cathode-side quadrupole coils 88, four target-side quadrupole coils 88, and two additional target-side coils 92. The coils may, in certain embodiments, be coupled in series based upon their respective groupings. For example, the cathode-side quadrupole coils may be coupled in series by connecting the first coil with the second, the second with the third, and the third with the fourth. Additionally, the target-side quadrupole coils may be coupled in series in a similar manner. Similarly, the additional target side coils 92 may also be coupled in series with one another. System control circuitry may be coupled to one or more power supplies to provide a current to pass through the respective coils. The power supplies may be coupled to each set of coils coupled in series or in any other suitable manner, as discussed below. The system control circuitry may control current switching in the coils. The magnetic field (that creates the focusing effect) of each quadrupole is proportional to the product of the number of turns and the current in a particular winding. If multiple windings are present on the same pole, the resultant field is the sum of the fields created by each winding by its own number of turns times its own current.

Figure 5:
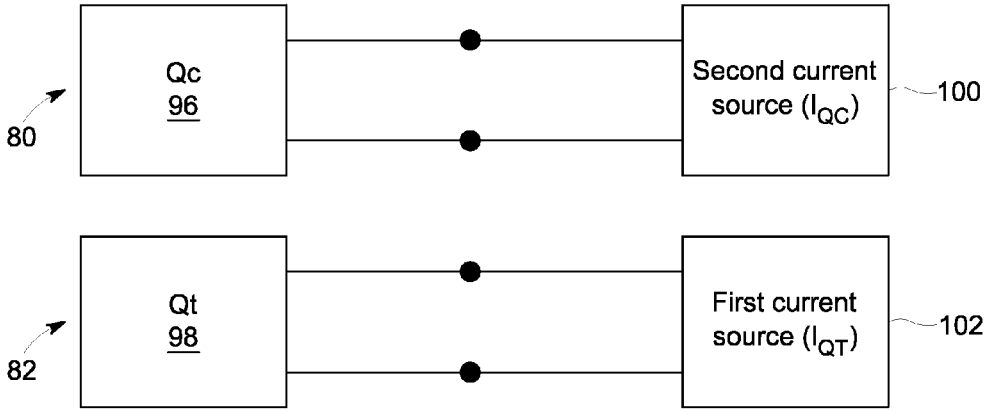
FIG. 5 PRIOR ART
FIG. 5 depicts a prior art configuration of a quadrupole magnet assembly, in accordance with aspects of the present disclosure.

The preceding discussion related to X-ray based imaging and treatment systems and to the magnetic assemblies used in such systems provides context for the magnetic focusing approaches discussed herein. In particular, as noted above, changes in the current flowing through two independent magnetic quadrupoles can result in undesired fluctuations in the size of a focal spot at the target within the X-ray source. An example of such a prior art approach is depicted in FIG. 5, where a cathode-side quadrupole 80 (having y number of windings) and a target side quadrupole 82 (having x number of windings, where x and y may be the same or different) are energized respectively by separate current sources. In this example a first current source 102 flows a current though windings 96 of the cathode-side quadrupole and a second current source 100 flows a current through the windings 98 of the target-side quadrupole 80. In practice, the current sources may be configured to quickly switch (i.e., within about 5 μs to about 25 μs) from one average current value to a substantially different average current value when the system requests it. Conversely, the current sources are configured to maintain the average current value substantially constant when so instructed by the system.

As noted above, such an arrangement of independently powered and controlled quadrupole currents can lead to undesired deviations in focal spot size. To address this issue, the current approach maintains the ratio between the current applied to the cathode-side quadrupole (i.e., $I_{QC}$) and the current applied to the target-side quadrupole (i.e., $I_{QT}$) to substantially maintain the size of the focal spot. That is, maintaining the quadrupole currents at a fixed ratio to one another reduces the sensitivity of the size of the focal spot to changes in the quadrupole currents. It should be noted, that although the present discussion is framed in the context of quadrupole currents and maintaining a fixed ratio of quadrupole currents, it is the ratio of the quadrupole magnetic fields that is actually being held constant. However, to the extent that the windings within each coil remain constant, changes to the respective quadrupole magnetic fields can be characterized as changes to the corresponding quadrupole currents.

As may be appreciated, maintaining a fixed ratio of quadrupole currents may be difficult in situations where $I_{QC}$ and $I_{QT}$ are controlled and/or supplied separately, as shown in FIG. 5. However, as discussed herein, one approach may instead be to provide a single current (i.e., a base current) that is applied to both quadrupoles. With a single base current flowing in both quadrupoles, the desired field ratio may be achieved by providing a different number of turns of the windings of each quadrupole. In addition, an offset current may also be applied to one of the quadrupoles, such as to "position" the linear relationship corresponding to the fixed ratio as needed to obtain the desired focal spot size. Typically the offset current will be small i.e., less than 10% of the base current.

As will be noted, in certain of the embodiments discussed below, this is accomplished using a first current source (i.e., an offset current source) for providing the offset current and a second current source (i.e., a base current source) for providing the base current to the coils of both quadrupoles. As will be appreciated, the accuracy of such current sources typically has a term that is a percentage of the full scale current output. Therefore, even if the offset current source, as discussed below, has the same relative accuracy as the base current source, the offset current source will still be more accurate on an absolute basis, as its full range is much smaller. The focal spot size sensitivity problem is thus solved by having: (1) a spot size that is less sensitive to the base current (which has the same accuracy); and (2) an offset current source that has better absolute accuracy (smaller range). It should also be noted that, with respect to embodiments where the cathode-side and target-side quadrupole coils are connected in series (such as in the embodiments described with respect to FIGS. 6 and 7), in order to maintain the same transition times, it may be necessary to increase the applied voltage. For example, in one implementation where x=y (i.e., where the number of windings are the same), the applied voltage may be doubled.

Figure 6:
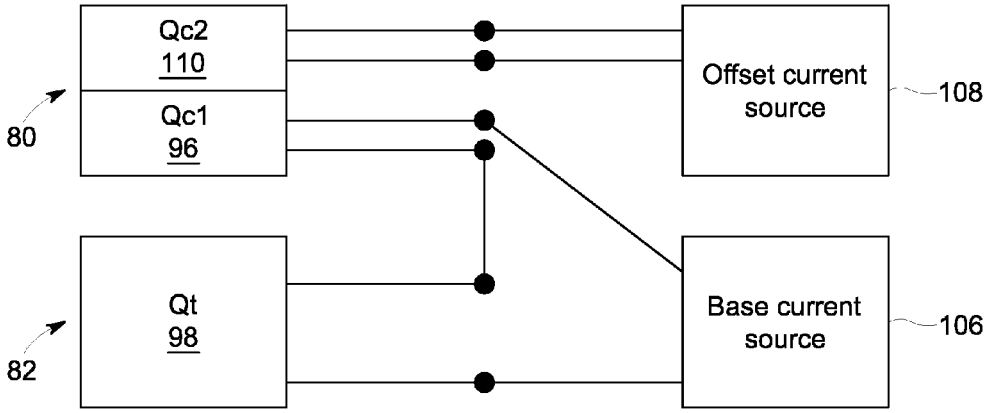
FIG. 6 depicts a first embodiment of a quadrupole magnet assembly in accordance with aspects of the present disclosure.

With the foregoing in mind, and turning to FIG. 6, in a first implementation, a base current (applied by base current source 106) flows through the primary windings 96, 98 of both the cathode-side quadrupole 80 and the target-side quadrupole 82, respectively. The number of primary windings on both quadrupoles may be the same or different. In addition, an offset or correction current (applied by offset current source 108), as discussed above, flows through a separate set of windings 110 on one of the quadrupoles (here depicted as the cathode-side quadrupole 80). The additional windings 110 may be applied on top of the primary windings associated with the respective quadrupole and the number of windings may differ from the primary windings provided on either quadrupole. It should be noted that the overall focusing magnetic field on the cathode side is given by the superposition of the magnetic fields created by the first and second set of cathode-side quadrupole windings 96 and 110 (shown as Qc1 and Qc2 in FIG. 6).

The embodiment shown in FIG. 6 may be implemented or used in various manners that are in accordance with the present disclosure. For example, in one implementation, the same base current may be flowed through the primary coils of both quadrupoles to achieve a consistent focal spot size. Similarly, a fixed field ratio will be determined and maintained between the primary windings of the two quadrupoles using the disclosed configuration. Alternatively, the same configuration may be used to allow adjustment of the field ratio between the two quadrupoles, such as by adjustment of the offset current. In addition, in a further embodiment, the same base current may be applied to both quadrupoles, but the number of windings of at least one of the quadrupoles may be switched between different settings. As discussed herein, any of these implementations may be employed to reduce the sensitivity of the focal spot size to changes in the currents flowing through the quadrupoles.

Figure 7:
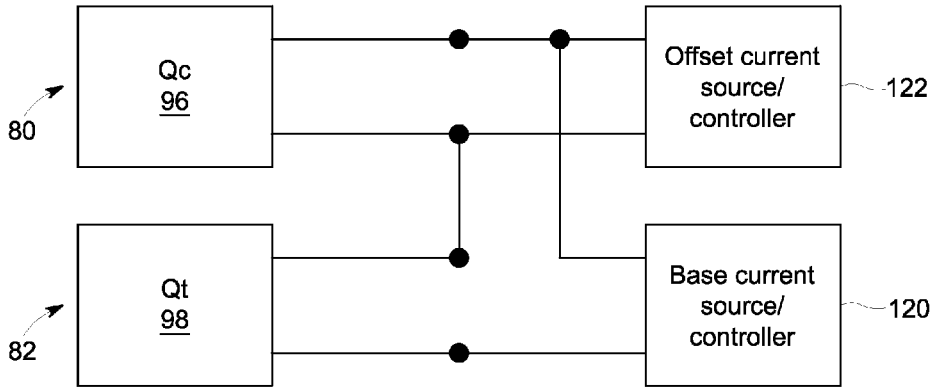
FIG. 7 depicts a second embodiment of a quadrupole magnet assembly in accordance with aspects of the present disclosure.

Turning to FIG. 7, in an alternative embodiment, a control modification approach may be employed instead. In this approach, the secondary or separate set of windings 110 may be omitted so that there is only one physical coil on each of the cathode-side quadrupole 80 and target-side quadrupole 82. A single base current may still be supplied or controlled (via base current source or base current source controller 120) to cathode-side quadrupole coils 96 and target-side quadrupole coils 98 and an offset current may still be applied or controlled (via offset current source or offset current source controller 122) to the set of coils on one of the quadrupoles (here depicted as the cathode-side quadrupole 80). However, unlike the previous embodiment, the base and offset currents may be controlled such that the currents are added or subtracted (as appropriate) before reaching the respective quadrupole (here depicted as the cathode-side quadrupole 80). Thus the appropriate offset is taken into account by a control modification such that the base current applied to the respective quadrupole is adjusted appropriately so that a single current may be applied to a single coil on the respective quadrupole to achieve the desired effect. This approach is particularly suited to a quadrupole supply topology using a half-bridge, with a common ground potential for both quadrupole supplies. It is also worth noting that the control modification approach described with respect to FIG. 7 may provide additional advantages, such as reduced focal spot size variation during transitions between different operational setpoints, such as when the two current sources have different adjustment speeds.

Figure 8:
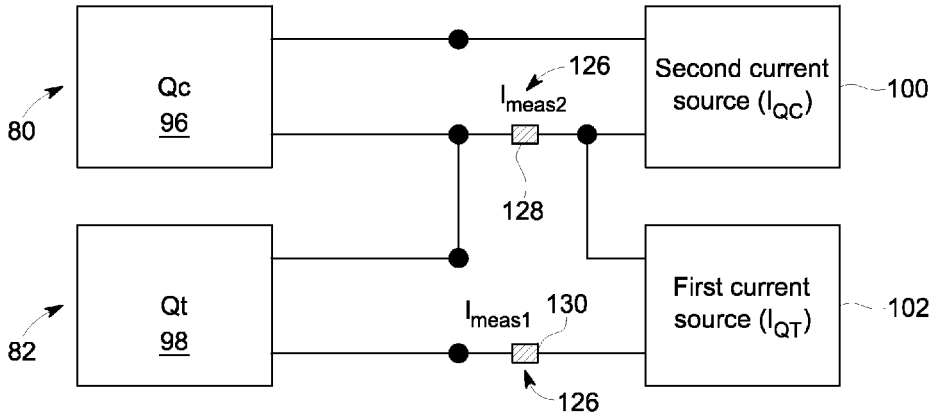
FIG. 8 depicts a third embodiment of a quadrupole magnet assembly in accordance with aspects of the present disclosure.

Turning to FIG. 8, in a further embodiment, a measurement system 126 may instead be employed to maintain the desired fixed ratio of quadrupole currents. In this arrangement, separate current sources 100 and 102 may power the respective cathode-side and target-side quadrupoles. The measurement system measures the current of one of the quadrupoles (here depicted as the target-side quadrupole, where the measurement is made by first current sensor 130) and the offset of the other quadrupole current (here depicted as the cathode-side quadrupole current, where the measurement is made by second current sensor 128). The offset of the second quadrupole current may be made with respect to the first quadrupole current scaled by a fixed factor or ratio. The scaling may be accomplished using a different winding number for the cathode side quadrupole and the target-side quadrupole. In one embodiment, the fixed ratio may be a factor of 1, i.e., the two respective quadrupole currents are measured and maintained in a 1:1 ratio. In general, the direction of the currents will be chosen so that the maximum value of the measured offset current is small relative to the maximum value of the base current being measured.

The preceding examples of implementations of the present approach address the issue of focal spot size sensitivity with respect to changes in quadrupole currents. In particular, by linking the quadrupole currents as discussed herein, the size of the focal spot on the target is less sensitive to current changes through the quadrupoles. In particular, in certain embodiments the ratio of the quadrupole currents is substantially fixed, which reduces the sensitivity of the size of the focal spot to current changes.

Technical effects of the invention include achieving a consistent focal spot size of an electron beam on a target of an X-ray generating component. In certain embodiments, magnetic focusing of the electron beam may be accomplished using a pair of quadrupole magnetic fields in which the quadrupole currents are linked so as to maintain a fixed ratio of the respective quadrupole fields, which reduces the sensitivity of the size of the focal spot to changes in the current running through the quadrupoles. Other technical advantages of the present approaches include the ability to use less expensive current source components to supply the quadrupoles and/or the use of smaller current sources than conventionally employed, since the present improvements are not achieved by improving operation of the current sources themselves.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. An X-ray tube, comprising:

a target;

a cathode assembly comprising a cathode configured to emit a stream of electrons toward the target during operation; and a magnetic focusing assembly configured to focus the stream of electrons onto a focal spot on the target during operation, the magnetic focusing assembly comprising:

a first quadrupole magnet assembly configured to generate a first magnetic field when a current is applied;

a second quadrupole magnet assembly configured to generate a second magnetic field when a current is applied;

wherein the first magnetic field and the second magnetic field in combination focus the electron beam on the focal spot; and wherein the first magnetic field and the second magnetic field are held in a substantially fixed ratio to one another during operation such that the size of the focal spot on the target remains substantially constant when the current through the quadrupole magnet assemblies is changed.

2. The X-ray tube of claim 1, further comprising:

a first current source configured to apply a base current to both the first quadrupole magnet assembly and the second quadrupole magnet assembly; and a second current source configured to apply an offset current to the first or second quadrupole magnet assembly.

3. The X-ray tube of claim 2, wherein the base current is applied to a first set of coils on the first quadrupole magnet assembly and the offset current is applied to a second set of coils on the first quadrupole magnet assembly.

4. The X-ray tube of claim 1, further comprising:

a first current source configured to apply a base current to both the first quadrupole magnet assembly and the second quadrupole magnet assembly; and a second current source configured to provide an offset current that increases or reduces the base current prior to the base current being applied to the first quadrupole magnet assembly.

5. The X-ray tube of claim 1, further comprising:

a first current source configured to apply a first current to the first quadrupole magnet assembly;

a second current source configured to apply a second current to the second quadrupole magnet assembly; and a measurement system configured to measure an offset between the first current and the second current.

6. The X-ray tube of claim 5, wherein the measurement system comprises:

a first current sensor configured to measure the first current; and a second current sensor configured to measure the second current.

7. The X-ray tube of claim 1, wherein the first quadrupole magnet assembly and the second quadrupole magnet assembly are electrically connected in series.

8. The X-ray tube of claim 1, comprising one or more current sources configured to switch from a first average current applied to the magnetic focusing assembly to a second average current within about 5 μs to about 25 μs.

9. A system employing generated X-rays, the system comprising:

an X-ray controller configured to generate control signals; and an X-ray source configured to generate X-rays in response to the control signals, the X-ray source comprising:

an electron emitter configured to emit a stream of electrons;

a target configured to emit X-rays when impacted by the stream of electrons; and a first quadrupole configured to generate a first magnetic field; and a second quadrupole configured to generate a second magnetic field, wherein the first magnetic field and the second magnetic field in combination focus the stream of electrons on the target;

wherein the first magnetic field and the second magnetic field are maintained in a substantially fixed relationship to one another such that the size of the focal spot where the stream of electrons is incident on the target remains substantially constant when the current through the quadrupole magnet assemblies is changed.

10. The system of claim 9, wherein the system comprises one of a medical imaging system or a medical treatment system.

11. The system of claim 9, wherein the system further comprises:

a system controller configured to control operation of the X-ray controller.

12. The system of claim 9, wherein the system further comprises:

a detector configured to detect X-rays emitted by the X-ray source; and a data acquisition system configured to acquire signals generated by the detector in response to the X-rays.

13. The system of claim 9, further comprising:

a first current source configured to apply a base current to both the first quadrupole and the second quadrupole; and a second current source configured to apply an offset current to the first or second quadrupole.

14. The system of claim 13, wherein the base current is applied to a first set of coils on the first quadrupole and the offset current is applied to a second set of coils on the first quadrupole.

15. The system of claim 9, further comprising:

a first current source configured to apply a base current to both the first quadrupole and the second quadrupole; and a second current source configured to provide an offset current that increases or reduces the base current prior to the base current being applied to the first quadrupole.

16. The system of claim 9, further comprising:

a first current source configured to apply a first current to the first quadrupole;

a second current source configured to apply a second current to the second quadrupole; and a measurement system configured to measure an offset between the first current and the second current.

17. The system of claim 16, wherein the measurement system comprises:

a first current sensor configured to measure the first current; and a second current sensor configured to measure the second current.

18. A method for focusing an electron beam within an X-ray source, the method comprising:

emitting a stream of electrons toward a target material, wherein the stream of electrons is incident on the target material within a focal spot;

magnetically focusing the stream of electrons on the target material by passing the stream of electrons through a first magnetic field and a second magnetic field, wherein the first magnetic field and the second magnetic field are maintained in a substantially fixed ratio to one another even when a current used to generate at least one of the magnetic fields is changed;

emitting X-rays from the focal spot on the target material.

19. The method of claim 18, wherein the focal spot remains substantially the same size when the current is changed.

20. The method of claim 18, wherein magnetically focusing the stream of electrons comprises:

applying a base current to both a first quadrupole and a second quadrupole of a magnet assembly; and applying a second current to the first or second quadrupole of the magnet assembly.

21. The method of claim 18, wherein magnetically focusing the stream of electrons comprises:

applying a base current to both a first quadrupole and a second quadrupole of a magnet assembly; and applying an offset current that increases or reduces the base current prior to the base current being applied to the first quadrupole.

22. The method of claim 18, wherein magnetically focusing the stream of electrons comprises:

applying a first current to a first quadrupole and a second current to a second quadrupole; and measuring an offset between the first current and the second current.

* * * * *